US008215046B2

(12) United States Patent
Chvala

(10) Patent No.: US 8,215,046 B2
(45) Date of Patent: Jul. 10, 2012

(54) FOREND WITH MULTIPLE LOCATOR RAILS

(75) Inventor: John R. Chvala, Grafton, WI (US)

(73) Assignee: Advanced Technology International USA, LLC, Milwaukee, WI (US)

( * ) Notice: Subject to any disclaimer, the term of this patent is extended or adjusted under 35 U.S.C. 154(b) by 127 days.

(21) Appl. No.: 12/839,760

(22) Filed: Jul. 20, 2010

(65) Prior Publication Data

US 2012/0017482 A1 Jan. 26, 2012

(51) Int. Cl.
*F41C 23/16* (2006.01)

(52) U.S. Cl. ..... 42/71.01; 42/72; 42/124

(58) Field of Classification Search ..... 42/71.01, 42/72, 85, 124

See application file for complete search history.

(56) References Cited

U.S. PATENT DOCUMENTS

| | | | | |
|---|---|---|---|---|
| 2,701,930 | A * | 2/1955 | Dolan | 428/19 |
| 6,792,711 | B2 * | 9/2004 | Battaglia | 42/114 |
| 8,091,265 | B1 * | 1/2012 | Teetzel et al. | 42/72 |
| 2009/0056191 | A1 * | 3/2009 | Battaglia | 42/71.01 |

* cited by examiner

*Primary Examiner* — Stephen M Johnson

(74) *Attorney, Agent, or Firm* — Andrus, Sceales, Starke & Sawall, LLP

(57) ABSTRACT

A mounting arrangement for use with a shotgun or rifle to selectively position accessories along the barrel of the rifle. The mounting arrangement includes a forend and a series of mounting rails that receive the desired accessories. The forend includes a series of locator rails equally positioned around the outer circumference and spaced from each other at approximately 45°. The spacing of the locator rails allows a user to selectively attach an accessory in a larger number of desired locations around the outer circumference of the forend. Each of the mounting rails and locator rails engage each other in a dovetail configuration to prevent the radial separation of the mounting rail from the locator rail.

15 Claims, 4 Drawing Sheets

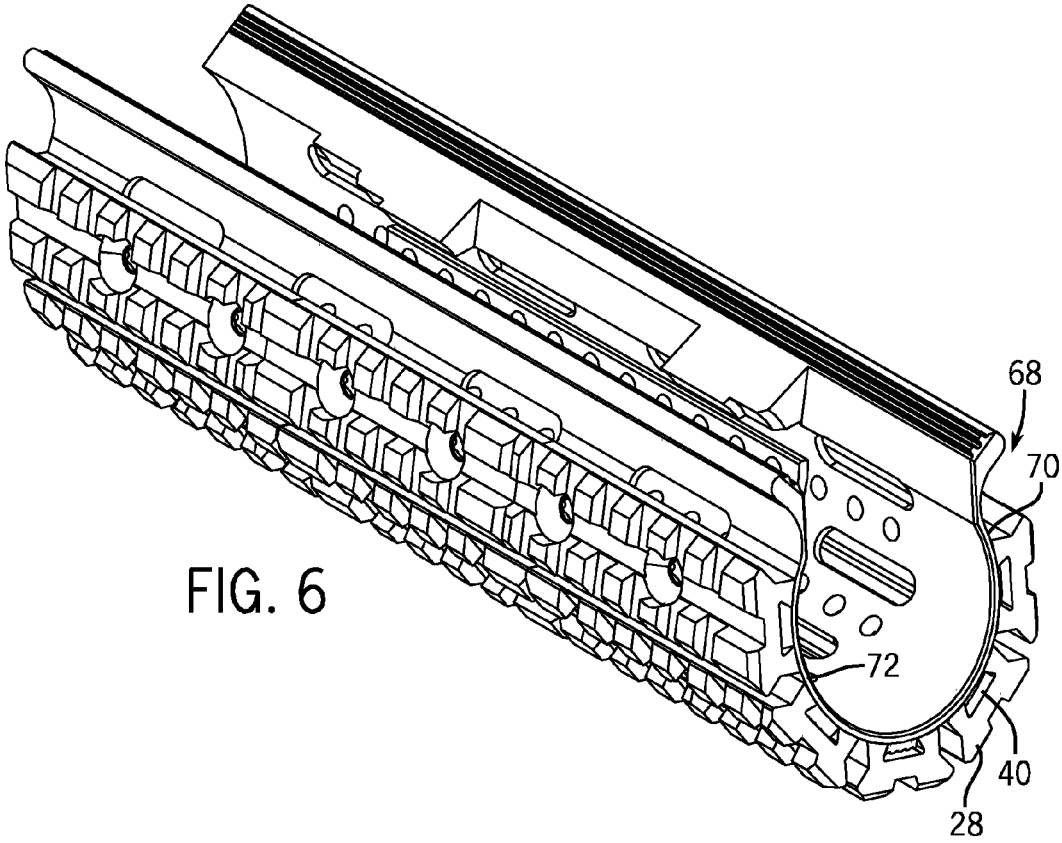
FIG. 6
FIG. 7
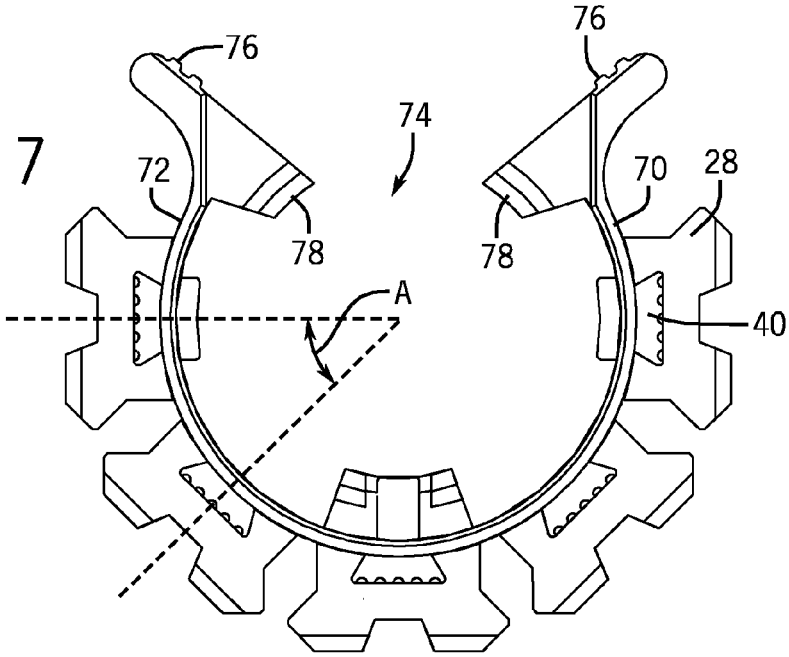

FOREND WITH MULTIPLE LOCATOR RAILS

BACKGROUND OF THE INVENTION

The present disclosure generally relates to a mounting arrangement for attaching one or more accessories to a rifle. More specifically, the present disclosure relate to a mounting arrangement that includes a forend having a series of locator rails that allow accessories to be positioned at an increased number of positions around the outer surface of the forend.

Presently, many different types of accessories are available for use with rifles. These accessories include front grips, rifle sites, rifle scopes, flashlights, bipods, and other types of accessories that may be desired by an individual user. Typically, a rifle or shotgun receives a forend that allows the accessories to be mounted to the rifle or shotgun. Currently available forends include four locator rails that are positioned 90° from each other around the generally circular circumference of the forend. The four locator rails allow the user to selectively position accessories at one of the four distinct positions. Each of the locator rails receives a mounting rail that allows the individual accessories to be mounted to the rifle or shotgun. Although the combination of currently available forends and mounting rails allow accessories to be securely attached to the shotgun or rifle, the currently available forends restrict the position and orientation of the accessories along the rifle or shotgun.

SUMMARY OF THE INVENTION

The present disclosure relates to a mounting arrangement for positioning accessories along the barrel of a shotgun or rifle. The mounting arrangement includes a forend attached to the rifle or shotgun body and a series of mounting rails that are selectively positionable along the length of the forend.

The forend forms part of the mounting arrangement and includes a body that extends between a first end and a second end. The body has an outer surface that includes a plurality of locator rails. The locator rails each selectively receive a mounting rail such that accessories can be attached to the mounting rail in a conventional manner.

In one embodiment of the disclosure, the main body of the forend includes a circular outer surface. The circular outer surface includes a plurality of locator rails that are equally spaced from each other at approximately 45° angular increments. In the embodiment that includes a circular cross section, the forend includes eight locator rails equally spaced around the circumference of the main body.

Each of the locator rails has a generally dovetail cross section that increases in width from the connection between the locator rail and the outer surface of the forend to an outer face surface. The dovetail configuration of each of the locator rails interacts with a similar dovetail configuration of the mounting slot formed in each of the mounting rails. The interaction between the locator rails and the mounting rails prevents the radial separation of the mounting rails from the locator rails.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 6 is an isometric view of a second embodiment of the mounting arrangement of the present disclosure; and FIG. 7 is an end view of the mounting arrangement shown in FIG. 5.

DETAILED DESCRIPTION OF THE INVENTION

Figure 1:
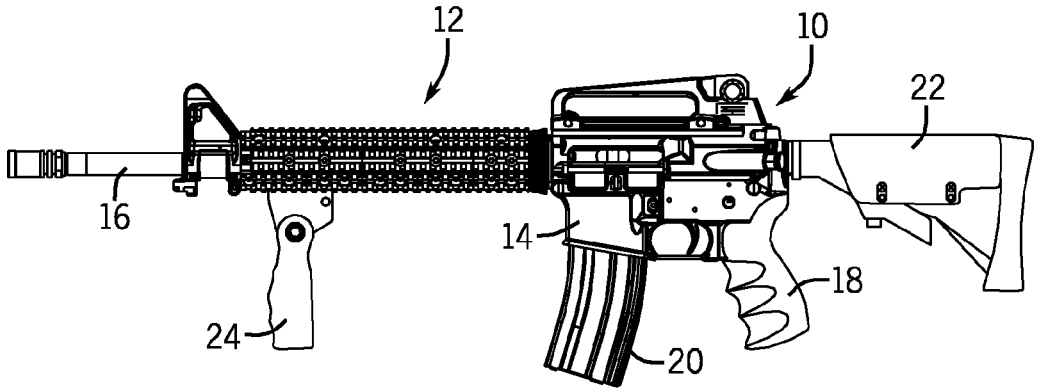
FIG. 1 is a front view of a rifle incorporating the mounting arrangement of the present disclosure.

FIG. 1 illustrates a rifle 10 incorporating a mounting arrangement 12 of the present disclosure. As illustrated in FIG. 1, the mounting arrangement 12 is mounted to the body 14 of the rifle 10 and surrounds a portion of the rifle barrel 16. The body 14 includes a pistol grip 18 and ammunition magazine 20. A stock 22 is also shown attached to the body 14. The pistol grip 18, stock 22 and magazine 20 are configurable components that allow a user to modify the size, function and appearance of the rifle 10 depending upon specific user requirements.

In the embodiment shown in FIG. 1, the mounting arrangement 12 allows a variety of different accessories to be mounted at different angular positions around the barrel 16. In the embodiment shown in FIG. 1, a grip 24 is shown positioned beneath the barrel 16. The grip 24 is securely attached to the mounting arrangement 12 and provides the user with a convenient place to grasp the front end of the rifle 12. Although a grip 24 is shown in FIG. 1, it is contemplated that a large number of other types of accessories, such as a bipod, rifle site, rifle scope, a flashlight, a bayonet or a variety of other accessories could be mounted to the mounting arrangement 12 as desired by the user. The mounting arrangement 12 thus provides the user with flexibility in choosing the type of accessory to be utilized with the rifle 10. It is important that the mounting arrangement 12 allows the user to quickly remove and replace accessories and to position the accessories in the most desirable location.

Figure 2:
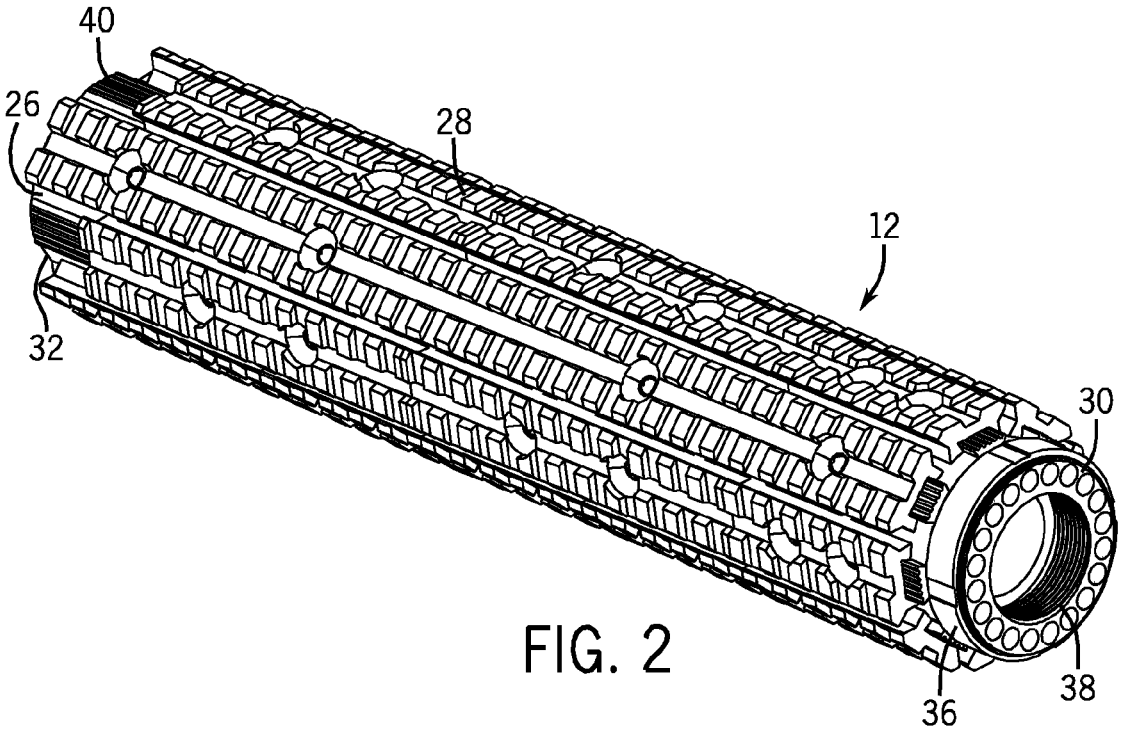
FIG. 2 is a perspective view of a forend including a series of mounting rails attached thereto.
Figure 3:
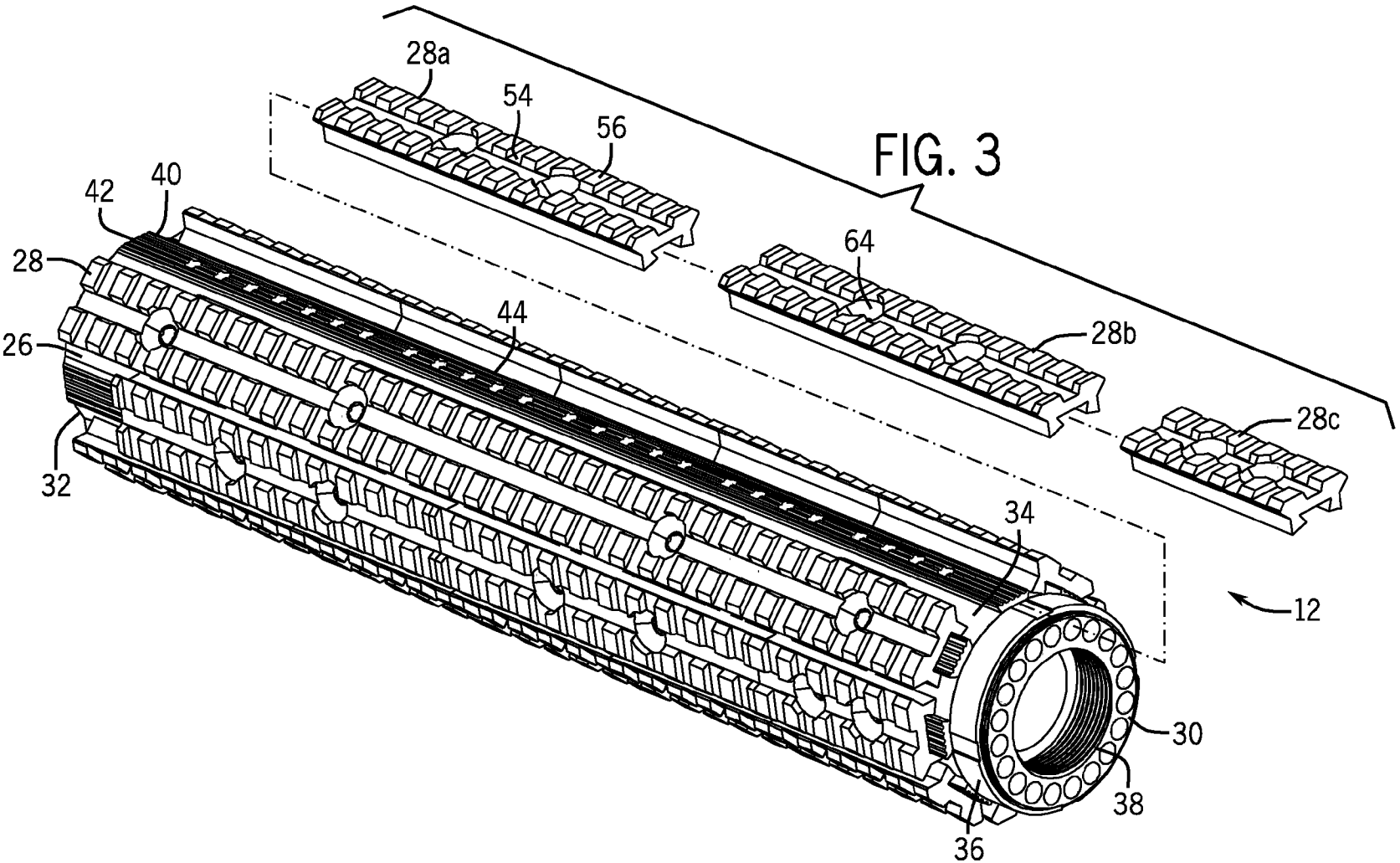
FIG. 3 is a partially exploded view of the forend and mounting rails.

Referring now to FIGS. 2 and 3, thereshown is a detailed configuration of one embodiment of the mounting arrangement. The mounting arrangement 12 generally includes a forend 26 and a series of individual mounting rails 28 that are selectively positionable along the forend 26. As will be described in detail below, the mounting rails 28 are selectively positionable along the length of the forend 26 at various different angular positions around the circular cross section of the forend, depending upon the specific user requirements.

The forend 26 shown in FIG. 3 extends from a first end 30 to a second end 32. The forend 26 has a generally cylindrical outer surface 34 in the embodiment illustrated. In the embodiment shown in FIG. 3, the first end 30 includes an attachment collar 36 having a threaded inner surface 38. The threaded inner surface 38 allows the forend 26 to be threadedly attached to the rifle body 14 in the manner shown in FIG. 1. Although the threaded attachment between the collar 36 and the rifle body 14 presents one method of attaching the forend 26 to the rifle, it should be understood that various different types of connections could be utilized while operating within the scope of the present disclosure.

Figure 4:
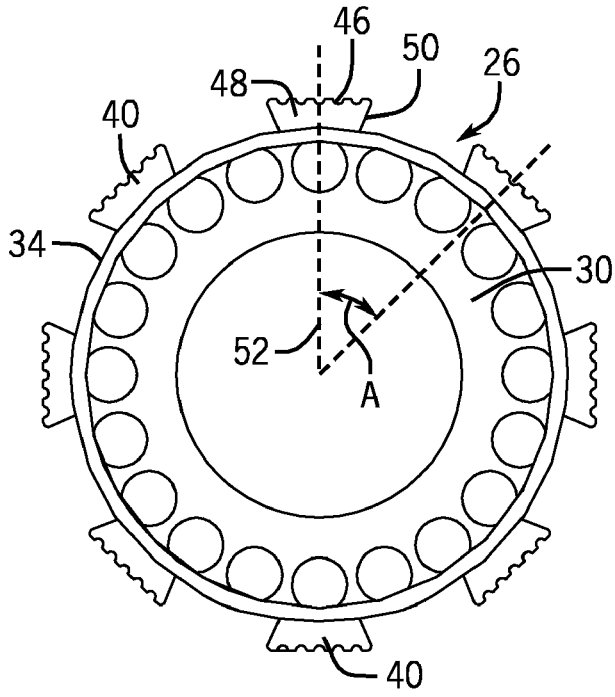
FIG. 4 is an end view of the forend and locator rails.

Referring now to FIG. 4, the forend 26 includes a series of locator rails 40 that each extend from the outer surface 34. The locator rails 40 are equally spaced from each other along the outer circumference of the forend 26. In the embodiment shown in FIG. 4, the forend 26 includes eight individual locator rails 40 that are each spaced from each other by angle A. Since the locator rails 40 are equally spaced around the entire circumference of the forend 26, the angle A in the embodiment shown in FIG. 4 is 45°.

Referring now to FIG. 3, each of the locator rails 40 extends continuously along the entire length of the forend from the attachment collar 36 to the second end 32. Each of the locator rails 40 includes a series of gripping ridges 42 having a uniform gripping contour along the length of each locator rail 40. Each of the locator rails 40 includes a series of attachment holes 44 that are pre-drilled into the forend 26 and sized to receive connectors at various locations along the entire length of the forend 26 from the first end 30 to the second end 32.

Referring back to FIG. 4, each of the locator rails 40 is integrally formed with the remaining portions of the forend 26. In the embodiment illustrated, the forend 26 is formed from a heat treated hard coat anodized military grade aluminum. However, various other materials are contemplated as being within the scope of the present disclosure.

Each of the locator rails 40 includes an outer face surface 46 that includes the series of gripping ridges 42. The gripping ridges 42 are spaced from and extend longitudinally of the main body of forend 26. Each locator rail 40 bonds with the outer surface 34 of the forend 26 along an inner face surface 48. The width of each locator rail 40 increases from the inner face surface 48 to the outer face surface 46 such that each locator rail 40 has a generally dovetail or trapezoidal cross section. The sidewalls 50 of each locator rail extend linearly outward at an angle relative to the radius of the forend 26 to create a draft angle. In the embodiment illustrated, the draft angle formed by each of the sidewalls 50 is approximately 60-68°, although other configurations are contemplated. The outer face of gripping surface 46 and the sidewalls 50 together define continuous mounting and gripping surfaces provided along the entire length of each locator rail 40.

Referring back to FIG. 3, the mounting arrangement 12 further includes the plurality of mounting rails 28. The use of mounting rails 28 are well known as a method of attaching accessories to a forend of a rifle. However, the mounting rails 28 formed in accordance with the present disclosure are unique to the present disclosure.

Each of the mounting rails 28 includes an outer surface 54 defined by a series of protrusions 56. As illustrated in the end view of FIG. 5, each of the mounting rails 28 includes a receiving channel 58. The receiving channel 58 is defined by a back wall 60 and a pair of inwardly sloping sidewalls 62. The shape of the receiving channel 58 corresponds to the dovetail shape of the corresponding locator rail 40 and thus increases from an inner end 63 to the back wall 60.

As can be understood in FIGS. 2 and 3, each of the mounting rails 28 can be slid along the length of one of the locator rails 40 to the desired position along the locator rail between the first end 30 and the second end 32. In one embodiment shown in FIG. 3, the mounting rail 28 includes three separate, different length sections 28*a*-28*c*. Alternatively, the mounting rail 28 could be a single piece section having an overall length nearly equal to the length of the forend between the first end 30 and the second end 32.

In the embodiment illustrated, each of the individual sections of the mounting rails 28*a*-28*c* includes one or more attachment openings 64 that each receive a connector (not shown). The individual connectors extend through the mounting rails 28 and are received in one of the attachment holes 44 formed along the length of the locator rail 40.

During use, each of the mounting rails 28 is slid along the selected locator rail into the desired location. Once in the desired location, one or more connectors are used to secure the mounting rail 28 to the respective locator rail 40. The individual connectors are used to prevent the longitudinal movement of the respective mounting rails 28 along the length of the forend 26. However, due to the dovetail interaction between each of the mounting rails 28 and the respective locator rail 40, radial separation between the mounting rails 28 and the locator rail 40 is prevented by the tapered configuration of or mating dovetail arrangement between the two components.

Figure 5:
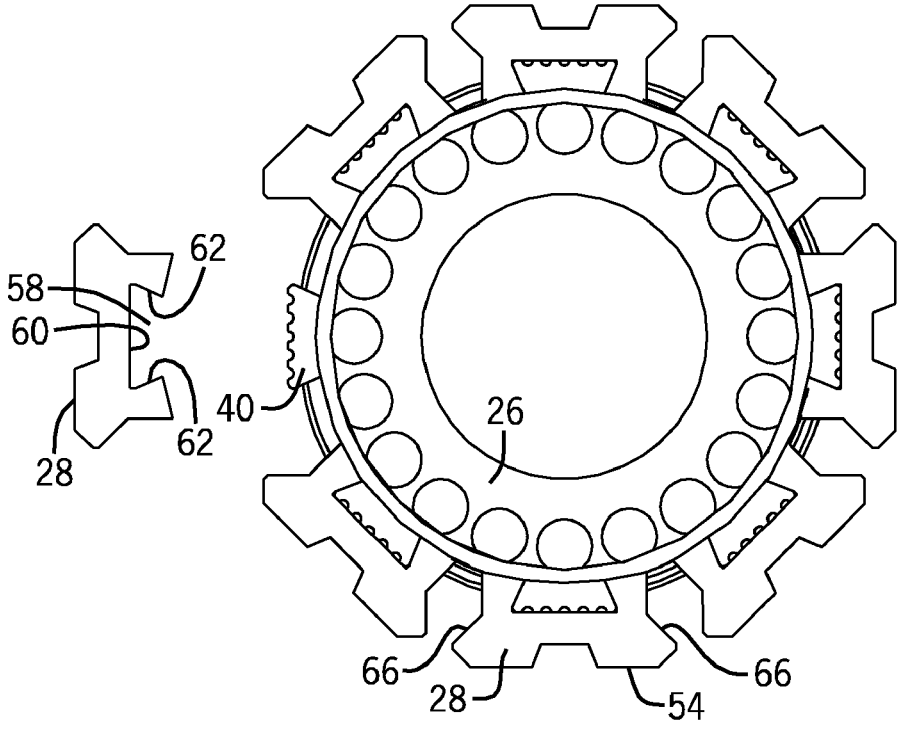
FIG. 5 is an end view of the forend and mounting rails.

As can be understood in FIGS. 4 and 5, the locator rails 40 are positioned at 45° angular increments around the outer circumference of the forend 26. When the forend 26 is mounted in the position shown in FIG. 4, one of the locator rails 40 is positioned at top dead center. Locator rails 40 are then located at 45°, 90°, 135°, 180°, 225°, 270°, and 315° from top dead center. The eight different angular positions around the outer circumference of the forend 26 allows the user increased flexibility when mounting an accessory to the forend 26. As an example, in the embodiment shown in FIG. 1, the grip 24 is shown mounted to the locator rail 40 at a position 180° from top dead center. However, other users may wish to have the grip 24 mounted at 135° or 225° from top dead center. The configuration of the forend 26 shown in FIGS. 4 and 5 allows for further flexibility for the user of the mounting arrangement of the present disclosure.

As described previously, the mounting rails 28 shown in FIG. 5 can be used to attach each of the accessories to the forend 26. The mounting rails 28 can be positioned along any one of the eight locator rails 40 shown in FIG. 5.

Once the mounting rails 28 are positioned in the desired location along the longitudinal length of the forend 26 as well as in the desired angular position, individual attachment devices can be used to secure the mounting rail to the locator rail in a conventional manner. The accessories typically engage the outer shoulders 66 of each mounting rail 28 and are held in position in a conventional manner. However, in accordance with the present disclosure, since the locator rails 40 are positioned at 45° increments around the outer circumference of the forend 26, individual accessories can be positioned at locations between the standard 0°, 90°, 180° and 270° locations present in currently available forends.

Referring now to FIGS. 6 and 7, thereshown is an alternate embodiment of the mounting arrangement, as illustrated by reference numeral 68. In the embodiment shown in FIG. 6, the mounting arrangement 68 is particularly useful with a shotgun in which the forend 70 does not completely surround the barrel 16. In the embodiment shown in FIG. 6, the forend 70 includes similar locator rails 40 positioned at 45° increments around the semi-complete cylindrical outer surface 72. Each of the locator rails 40 has an identical configuration to the embodiment shown in the previous Figures. Likewise, the mounting rails 28 also each have a similar configuration, as described.

Referring now to FIG. 7, the forend 70 has an open top end 74 defined by a pair of ends 76. The forend 70 includes a mounting arrangement 78 that allows the forend 70 to be mounted to a shotgun in a conventional manner. Although the embodiment shown in FIG. 7 includes only five locator rails 40, the locator rails 40 are equally spaced at 45° angles, as illustrated by the same reference angle A.

Although the forend 26 is shown in the embodiment of FIGS. 3 and 4 as including a series of mounting rails 28 attached to each of the locator rails 40, the forend 26 could be utilized without any mounting rails attached thereto. Since each of the locator rails includes a series of gripping ridges 42 and protrudes only slightly past the outer surface, the series of locator rails 40 present a relatively comfortable outer surface for gripping by a user. Thus, if the forend 26 is utilized without any accessories, all of the mounting rails 28 can be removed and the forend 26 used alone.

I claim:

1. A forend for use with a rifle, comprising:

a main body extending from a first end to a second end; and a plurality of locator rails spaced along an outer surface of the main body, wherein the plurality of locator rails are equally spaced approximately 45° from each other along the outer surface of the main body, wherein each of the locator rails includes a pair of sidewalls extending radially outward from the outer surface of the main body, and an outer face gripping surface spaced from the outer surface of the main body and joining the sidewalls, the sidewalls and the outer face gripping surface extending substantially continuously along an entire length of the main body between the first and second ends, the sidewalls and the outer face gripping surface together defining continuous mounting and gripping surfaces provided along the entire length of each locator rail.

2. The forend of claim 1 wherein each of the locator rails has a generally dovetail cross-section.

3. The forend of claim 1 wherein the width of the each of the locator rails increases from the connection to the outer surface of the main body to the outer face gripping surface.

4. The forend of claim 1 wherein the main body is cylindrical and the locator rails are equally spaced around the entire outer surface of the main body.

5. The forend of claim 4 wherein the main body includes eight locator rails.

6. The forend of claim 3 wherein the outer face gripping surface of each locator rail includes a series of gripping ridges extending longitudinally of the main body.

7. The forend of claim 1 wherein the outer face gripping surface has a uniform gripping contour along an entire length thereof.

8. A mounting arrangement for mounting desired accessories to a gun, comprising:

a forend having a main body extending from a first end to a second end;

a plurality of locator rails equally spaced approximately 45° from each other along an outer surface of the main body, each of the locator rails having a length extending continuously along an entire length of the main body and defining continuous mounting and gripping surfaces provided along an entire length of each locator rail; and at least one mounting rail slidably attached to one of the plurality of locator rails by means of a mating dovetail arrangement between the mounting rail and the locator rail to prevent radial separation therebetween, the mounting rail having a mounting slot received by the locator rail.

9. The mounting arrangement of claim 8 wherein each of the locator rails extends radially outward from the outer surface of the main body to an outer face gripping surface, wherein the width of the each of the locator rails increases from the connection to the outer surface of the main body to the outer face gripping surface.

10. The mounting arrangement of claim 9 wherein the mounting slot has a tapered cross-section that increases in width from an inner end of the mounting slot to a back surface of the mounting slot.

11. The mounting arrangement of claim 8 wherein the mounting rail is selectively positionable along the length of the locator rails, and has a length which is equal to or less than the length of the locator rail.

12. The mounting arrangement of claim 8 wherein the forend is formed from anodized aluminum.

13. The mounting arrangement of claim 8 wherein the main body is cylindrical and the locator rails are equally spaced around the entire outer surface of the main body.

14. The mounting arrangement of claim 13 wherein the main body includes eight locator rails.

15. The mounting arrangement of claim 9 wherein the outer face gripping surface of each locator rail includes a series of gripping ridges spaced from and extending longitudinally of the main body.

* * * * *